US012421812B2

(12) United States Patent
Yard

(10) Patent No.: US 12,421,812 B2
(45) Date of Patent: Sep. 23, 2025

(54) WIRELESS COMMUNICATIONS WITH DOWNHOLE DEVICES USING COIL HOSE

(71) Applicant: Expro North Sea Limited, Aberdeen (GB)

(72) Inventor: James Alexander Yard, Bournemouth (GB)

(73) Assignee: Expro North Sea Limited, Dyce Aberdeen (GB)

( * ) Notice: Subject to any disclaimer, the term of this patent is extended or adjusted under 35 U.S.C. 154(b) by 51 days.

(21) Appl. No.: 17/927,267

(22) PCT Filed: May 17, 2021

(86) PCT No.: PCT/EP2021/063036
§ 371 (c)(1),
(2) Date: Nov. 22, 2022

(87) PCT Pub. No.: WO2021/233850
PCT Pub. Date: Nov. 25, 2021

(65) Prior Publication Data

US 2023/0203896 A1 Jun. 29, 2023

(30) Foreign Application Priority Data

May 22, 2020 (GB) ..... 2007675

(51) Int. Cl.
*E21B 17/20* (2006.01)
*E21B 47/13* (2012.01)
*E21B 47/14* (2006.01)

(52) U.S. Cl.
CPC ..... *E21B 17/206* (2013.01); *E21B 47/13* (2020.05); *E21B 47/14* (2013.01)

(58) Field of Classification Search
CPC ..... E21B 17/206; E21B 17/20; E21B 47/13; E21B 47/14
See application file for complete search history.

(56) References Cited

U.S. PATENT DOCUMENTS 6,065,540 A * 5/2000 Thomeer ..... E21B 17/206 166/242.6
7,900,699 B2 3/2011 Ramos
(Continued)

FOREIGN PATENT DOCUMENTS

EP 911483 A2 * 4/1999 ..... E21B 17/02
EP 0911483 B1 8/2006
(Continued)

*Primary Examiner* — Caroline N Butcher
(74) *Attorney, Agent, or Firm* — Getz Balich LLC

(57) ABSTRACT

An apparatus for providing communication with a downhole device positioned within a wellbore is provided. The apparatus includes a flexible hose configured to be run into the wellbore during a well intervention process and to provide a fluid communication path from surface into the wellbore. The flexible hose includes at least one communication medium forming at least part of an outer wall thereof. The apparatus further includes a downhole device for positioning within the wellbore and coupled to the communication medium for transference of a signal between the downhole device and the communication medium; and a surface communication unit for communicating data to the downhole device and/or receiving data from the downhole device, wherein the surface communication unit is coupled to the communication medium for transference of a signal between the surface communication unit and the communication medium.

28 Claims, 5 Drawing Sheets

(56) References Cited

U.S. PATENT DOCUMENTS

| | | | | |
|---|---|---|---|---|
| 10,260,299 | B2 | 4/2019 | Randall | |
| 2012/0125607 | A1* | 5/2012 | Parsche | H01Q 1/04 166/57 |
| 2018/0023352 | A1* | 1/2018 | Sherman | G02B 6/4401 385/101 |

FOREIGN PATENT DOCUMENTS

| | | | |
|---|---|---|---|
| WO | 9721900 | W | 6/1997 |
| WO | 2016137663 | A1 | 9/2016 |

* cited by examiner

WIRELESS COMMUNICATIONS WITH DOWNHOLE DEVICES USING COIL HOSE

This application claims priority to PCT Patent Appln. No. PCT/EP2021/063036 filed May 17, 2021, which claims priority to Great Britain Patent Appln. No. 2007675.8 filed May 22, 2020, which are hereby incorporated herein by reference in their entireties.

BACKGROUND OF THE INVENTION

1. Technical Field

The present invention generally relates to downhole communication, and specifically to apparatus for providing communication with a downhole device and methods for communicating data with a downhole device.

2. Background Information

Well intervention in the oil and gas industry is an operation carried out during, or at the end of the production life of a well that alters the state of a wellbore of the well, provides wellbore diagnostics or data or manages the production of the well. Examples of intervention or well work include well stimulation, which involves the treatment of a reservoir formation with a stimulation fluid, such as an acidic fluid, to enable enhanced production of reservoir fluid; memory logging from one or more downhole tools; and placing or recovering wellbore equipment such as plugs, gauges and valves.

Intervention may involve the use of wireline or coiled tubing. Wireline operations involve introducing one or more of a cable, wireline or slickline into a wellbore. A wireline is an electrical cable used to lower tools into a wellbore and transmit data about the conditions of the wellbore sometimes referred to as wireline logs. A slickline is a thin cable introduced into a wellbore to deliver and retrieve tools downhole.

Wireline operations may involve running a cable into a wellbore from a vessel or platform. A tool may be attached to the cable and the weight of the tool, or additional weight, may assist in running the tool into the wellbore. Generally, wireline operations have a relatively small footprint and require few personnel to implement. However, wireline operations do not allow for hydraulic fluid communication between the surface, and the tool or downhole equipment.

Coiled tubing generally comprises a long metal pipe, normally 25 to 83 mm (approximately 1 to 3.25 inches) in diameter, which is supplied on a reel at surface. Coiled tubing is generally made of steel alloy and is significantly heavier than wireline. The coiled tubing is deployed via a tubing guide (goose neck) which is an arch that guides the tubing from its stored horizontal orientation on the reel into a vertical orientation for running into the well. The arch may be provided with a series of rollers spaced along the length of coiled tubing to reduce friction as the coiled tubing passes along the arch. An injector head is used to push coiled tubing into the wellbore or pull the coiled tubing out of the wellbore when the particular intervention operation is complete. A typical injector head consists of a pair of endless chains each mounted on a pair of spaced sprockets and each having a straight run engaging the coiled tubing. The coiled tubing is compressed between the chains, which are hydraulically driven to push the tubing downwardly into the wellbore or pull it upwardly out of the wellbore.

While coiled tubing offers hydraulic communication and high circulation rate, it is generally heavy, bulky and time consuming to plan and mobilize. In particular, coiled tubing may involve significant rig-up and lifting (approximately two to three days); considerable cost (more than 1 million USD); a high number of personnel (11 or more); and a relatively heavy and large footprint. Furthermore, coiled tubing may only be deployed on large rigs or platforms or spooled from a vessel.

While wireline and coiled tubing are known, alternatives are desired that at least partially address the issues mentioned while having at least some of the operational uses.

This background serves only to set a scene to allow a person skilled in the art to better appreciate the following description. Therefore, none of the above discussion should necessarily be taken as an acknowledgement that that discussion is part of the state of the art or is common general knowledge. One or more aspects/embodiments of the invention may or may not address one or more of the background issues.

SUMMARY

An aspect of the present disclosure relates to an apparatus for providing communication with a downhole device positioned within a wellbore.

An aspect of the present disclosure relates to an apparatus for providing communication with a downhole device positioned within a wellbore, the apparatus comprising: a flexible hose configured to be run into the wellbore during a well intervention process and to provide a fluid communication path from surface into the wellbore, wherein the flexible hose comprises at least one communication medium forming at least part of an outer wall thereof; a downhole device for positioning within the wellbore and coupled to the communication medium for transference of a signal between the downhole device and the communication medium; and a surface communication unit for communicating data to the downhole device and/or receiving data from the downhole device, wherein the surface communication unit is coupled to the communication medium for transference of a signal between the surface communication unit and the communication medium.

As the communication medium forms at least part of the outer wall of the flexible hose, additional communication medium, e.g. electrical cables, are not required within the flexible hose. As such, the limited volume available in the flexible hose may be employed for fluid communication and/or the size of the flexible hose of the may decreases. This may improve the versatility and flexibility of use of the flexible hose. This improved flexible hose may be smaller and lighter than conventional coil hoses. Furthermore, issues relating to movement of electrical cables within the flexible hose may be at least partially removed.

In contrast with coiled tubing, the flexible hose or coil hose is lighter and requires fewer personnel to mobilize and deploy (generally from 4 to 6 people). The flexible hose may be supplied on a reel at surface, at a rig and/or on a vessel.

The flexible hose may be a high-pressure hose specifically designed to withstand pressure up to 86,184 kPa (12,500 psi). The flexible hose may be reinforced. The flexible hose may have a safety factor of four (4). The flexible hose may comprise multiple layers of high tensile steel wires. The flexible hose may comprise an outer layer. The outer layer may be made of thermoplastic material. The thermoplastic may protect the flexible hose from damage and allow for a degree of compression of the flexible hose.

In contrast with coiled tubing, the flexible hose may be gravity fed into the wellbore without the use of an injector head. This may save set up time and costs as well as require fewer personnel for deployment.

The fluid communication path may be used to provide hydraulic control to one or more downhole tool, downhole of the flexible hose. As such, the flexible hose may be sized to accommodate hydraulic fluid sufficient for controlling one or more downhole tools.

As previously stated, the flexible hose may provide a fluid communication path from surface into the wellbore. The wellbore may be the main wellbore of a well. In addition, the flexible hose may provide a fluid communication path from surface into an annulus defined between tubing, and casing or lining in the well. As such, the flexible tubing may provide for intervention or well work in annuli of the well. The flexible tubing may provide for annulus intervention.

Coupling the downhole device to the communication medium may comprise establishing electrical communication, which may be wired or wireless, between the communication medium of the flexible hose and the downhole device.

The downhole device may be a downhole tool. Exemplary tools include downhole gauges such as pressure gauges. The downhole tool may comprise one or more sensors configured to detect a parameter downhole such as pressure, stress, strain, temperature, resistivity, force, current, voltage, shock, vibration and flow rate.

The downhole device may physically connect to an end of the flexible hose. In particular, the downhole device may physically connect to one or more fluid lines and/or communication media. The one or more fluid lines may be isolated from wellbore pressure. The connection may be a releasable connection. The downhole device may be connected to a downhole end of the flexible hose. The downhole device may weight down the flexible hose during deployment. The downhole device may comprise a bottom hole assembly (BHA). The BHA may comprise a drill bit, mud motor, stabilizers, drill collar, drillpipe, jarring devices (jars), crossovers for various threadforms, end connector, dual flapper valves, straight pull release components, swivel assembly, eight board, turbine and cleaning nozzles.

Prior to connection to the flexible hose, the downhole device may be assembled, tested and programmed/configured for a particular application.

The downhole device may be positioned downhole in a wellbore prior to running the flexible hose in the wellbore. The downhole device may not be physically connected to one or more fluid lines. However, the downhole device may still be coupled to the communication medium for transference of a signal between the downhole device and the communication medium even if the downhole device is not physically connected to the one or more fluid lines.

The surface communication unit may be located at the surface or a sub-sea location. The unit may be located on a drill rig, vessel, drilling platform or mobile offshore drilling unit (MODU). The surface communication unit may provide fluid to the one or more tubes forming the fluid communication path. The surface communication unit may comprise a controller for controlling operation of the downhole device.

The fluid communication path may be provided by one or more fluid lines. Each fluid line may be configured to provide fluid communication between uphole and downhole locations. The fluid line may provide fluid communication between the downhole device and a fluid source located at surface. A fluid line may take the form of a tube.

The communication medium may surround the one or more fluid lines. The communication medium may encircle, enclose, encompass, and/or circumscribe the one or more fluid lines.

By using the communication medium surrounding the one or more fluid lines, no additional cabling is required to communicate between the downhole device and the surface communication unit. As such, the limited volume available in the fluid communication path of the flexible hose is not used for electric or acoustic communication medium such as cabling. Instead, the surrounding communication medium forms at least part of an outer wall of the flexible hose between the downhole device and the surface communication unit. As the one or more fluid lines may be larger and/or the flexible hose may be smaller thereby increasing fluid communication capacity and/or reducing the weight and size of the flexible hose.

The communication medium of the flexible hose may comprise a first metallic element extending at least partially along a length of the flexible hose. The first metallic element may extend along the entire length of the flexible hose.

The communication medium of the flexible hose may comprise a second metallic element. The second metallic element may be electrically isolated from the first metallic element. The second metallic element at least partially along a length of the flexible hose. The second metallic element may be electrically isolated from the first metallic element by one or more nylon layers.

The first metallic element may comprise a first braid and/or the second metallic element may comprise a second braid. The first and second braids may be co-axial. The first and/or second braids surround a central bore of the flexible hose.

The communication medium may further comprise a third metallic element extending at least partially along a length of the flexible hose. The third metallic element may be electrically isolated from at least one of the first and second metallic elements. The third metallic element may be electrically isolated by one or more nylon layers.

The communication medium may further comprise a fourth metallic element extending at least partially along a length of the flexible hose.

The fourth metallic element may be electrically isolated from at least one of the first, second and third metallic elements. The fourth metallic element may be electrically isolated by one or more nylon layers.

At least two of the first, second, third and fourth metallic element may be bonded to each other. The first metallic element may be bonded to the second metallic element. The second metallic element may be boned to the first and third metallic elements. The third metallic element may be bonded to the second and fourth metallic elements. The fourth metallic element may be bonded to the third metallic element. The metallic element may be bonded to each other with one or more adhesives.

At least one of the first, second, third and fourth metallic element may comprise steel. At least one of the first, second, third and fourth metallic element may comprise high tensile steel.

The outer wall of the flexible hose may comprise a flexible material. The flexible material may take the form of a flexible layer. The flexible material or layer may be a tensile membrane. The tensile membrane may be configured to stretch such that the metallic elements do not stretch. In particular, the tensile membrane may be configured to stretch when connected to the downhole device deployed downhole of the surface communication unit. As such, the weight of the downhole device is taken by the tensile membrane instead of having weight of the metallic elements of the flexible hose.

The flexible material may further comprise a metallic element. Signal transference may occur through the metallic element. The metallic element of the flexible material may form the described third metallic element.

The outer wall of the flexible hose may comprise a sheath. The sheath may electrically isolate metallic elements. The sheath may electrically isolate the metallic element of the flexible material and one or more other metallic elements. The sheath may consist of an inner and an outer sheath. The inner sheath may electrically isolate metallic elements as described. The outer sheath may protect element within the outer sheath. These elements may include any one the described metallic elements and flexible material. The inner and outer sheaths may comprise thermoplastic.

The flexible hose may be configured for storage at surface on a drum. The flexible hose may be further configured to be unwound from the drum during deployment in a wellbore.

The flexible hose may be a coil hose.

The signal transferred between the downhole device and communication medium may be at least one of an electromagnetic signal and an acoustic signal. If the signal transferred is an electromagnetic signal then at least one metallic element may be used for signal transference. A second metallic element may be used to ground the electromagnetic signal. If the signal transferred is an acoustic signal then at least one metallic element may be used for signal transference. The communication medium may comprise a single metallic element.

The signal transferred between the surface communication unit and the communication medium may be at least one of an electromagnetic signal and an acoustic signal. If the signal transferred is an electromagnetic signal then at least one metallic element may be used for signal transference. A second metallic element may be used to ground the electromagnetic signal. If the signal transferred is an acoustic signal then at least one metallic element may be used for signal transference. The communication medium may comprise a single metallic element.

The surface communication unit may comprise one or more electroacoustic or acoustic transducers for converting an outgoing electrical signal to an acoustic signal, the acoustic signal being for transference to the downhole device via the communication medium. Furthermore, one or more transducers may be for converting an incoming acoustic signal to an electrical signal, the acoustic signal transferred from the downhole device via the communication medium.

The downhole device may comprise one or more electroacoustic or acoustic transducers for converting an outgoing electrical signal to an acoustic signal, the acoustic signal for transference to the surface communication medium via the communication medium. Furthermore, one or more transducers may be for converting an incoming acoustic signal to an electrical signal, the acoustic signal transferred from the surface communication unit via the communication medium.

The flexible hose may comprise the described one or more electroacoustic or acoustic transducers.

The downhole device may comprise at least one of a measurement device, a flow control device, a perforating device and a setting device. The measurement device may be a downhole gauge configured to detect a parameter, a production logging tool, a well logging tool or a caliper. The parameter may be at least one of pressure, temperature, electrical resistivity, conductivity, force, strain, etc. The flow control device may be a valve. The perforating device may be a perforating gun. The setting device may be a packer or a plug.

The apparatus may further comprise a communication relay for positioning within the wellbore and coupled to the communication medium for transference of a signal between the communication relay and the communication medium, The downhole device may be configured to be positioned downhole of the communication relay. The downhole device may be coupled to the communication medium for transference of a signal between the downhole device and the communication relay.

The downhole device may be for positioning within a section of the wellbore. The downhole device may be configured to isolate the section of wellbore.

The downhole device may be for measuring a property of a reservoir and/or wellbore fluid. Exemplary properties include pressure, stress, strain, temperature, resistivity, force, current, voltage, shock, vibration and flow rate.

The surface communication unit may be configured to control actuation of the downhole device to pressure test the section via transmission of a control command on the communication medium.

The downhole tool may be a perforating device. The surface communication unit may be configured to control actuation of the perforating device via transmission of a control command on the communication medium.

The signal may be at least one of a data communication signal and a power signal.

The surface communication unit may comprise a processor and a memory. The processor may process data stored in the memory. The processor may process data received from the downhole device. The processor may control the downhole device. The processor may process data received from the downhole device and/or control operation of the downhole device. The memory may store commands for operation of the memory and/or store data received form the downhole device.

The memory may comprise any suitable memory or storage device such as random-access memory (RAM), static RAM (SRAM), dynamic RAM (DRAM), non-volatile RAM (NVRAM), read-only memory (ROM), or Flash memory. The processor may have a single-core processor or multiple core processors composed of a variety of materials, such as silicon, polysilicon, high-K dielectric, copper, and so on.

The described apparatus may be used in drill stem testing (DST), well intervention or tubing-conveyed perforating (TCP). Furthermore the described apparatus may be used in onshore or subsea/offshore applications. The described apparatus may be used in packer and plug activation, gun trigger, valve control, and/or collecting real-time data from downhole devices such as downhole tools and gauges.

Use of the described apparatus allows for single run actuation via the fluid control path provided by the flexible hose of a variety of downhole devices such as plug, packers, and fluid pumping, e.g. clean-up fluid, without the need for an additional run to verify results as downhole devices may be controlled and data may be collected via signal transference along the communication medium. This single run operation, communication and/or control may reduce operation costs and times.

Another aspect of the present disclosure relates to a method for communicating data to and/or from a downhole device positioned within a wellbore using a flexible hose, the flexible hose comprising at least one communication medium forming at least part of an outer wall thereof, the method comprises: coupling a downhole device to a communication medium of a flexible hose, the downhole device for positioning within a wellbore; coupling a surface communication unit to the communication medium of the flexible hose, the surface communication unit for communicating data to the downhole device and/or receiving data from the downhole device; and running the flexible hose in the wellbore during a well intervention process, the flexible hose for providing a fluid communication path from surface into the wellbore.

The method may further comprise communicating a signal between the downhole device and the communication medium and/or between the communication medium and the surface communication unit.

Communicating the signal may comprise communicating the signal along at least one of a first metallic element extending at least partially along a length of the flexible hose, and a second metallic element extending at least partially along a length of the flexible hose. The second metallic element electrically may be isolated from the first metallic element. The second metallic element may be electrically isolated by one or more nylon layers.

Communicating the signal may comprise communicating the signal along at least one of first, second, third and fourth metallic elements, each element extending at least partially along a length of the flexible hose. The elements may be electrically isolated from each other. The metallic elements may be electrically isolated by one or more nylon layers.

The method may further comprise communicating a signal between the downhole device and a communication relay for positioning within the wellbore and coupled to the communication medium for transference of a signal between the communication relay and the communication medium.

The method may further comprise detecting parameters at the downhole device downhole of the surface communication unit.

The method may further comprise communicating actuation of the downhole device via the data communication signal between the downhole device and the communication medium.

The data communication signal between the downhole device and communication medium may be at least one of an electromagnetic signal and an acoustic signal.

If the data communication signal is an electromagnetic signal then at least one metallic element may be used for signal transference. A second metallic element may be used to ground the electromagnetic signal. If the signal is an acoustic signal then at least one metallic element may be used for signal transference. The communication medium may comprise a single metallic element The data communication signal between the surface communication unit and the communication medium may be at least one of an electromagnetic signal and an acoustic signal.

If the data communication signal is an electromagnetic signal then at least one metallic element may be used for signal transference. A second metallic element may be used to ground the electromagnetic signal. If the signal is an acoustic signal then only one metallic element may be used for signal transference. The communication medium may comprise a single metallic element.

The signal may be at least one of a data communication signal and a power signal.

The described method may incorporate any one or more of the described aspects of the apparatus.

Aspects of the inventions described may include one or more examples, embodiments or features in isolation or in various combinations whether or not specifically stated (including claimed) in that combination or in isolation. It will be appreciated that one or more embodiments/examples may be useful in a downhole environment.

BRIEF DESCRIPTION OF THE DRAWINGS

A description is now given, by way of example only, with reference to the accompanying drawings, in which.

DETAILED DESCRIPTION OF THE INVENTION

Figure 1:
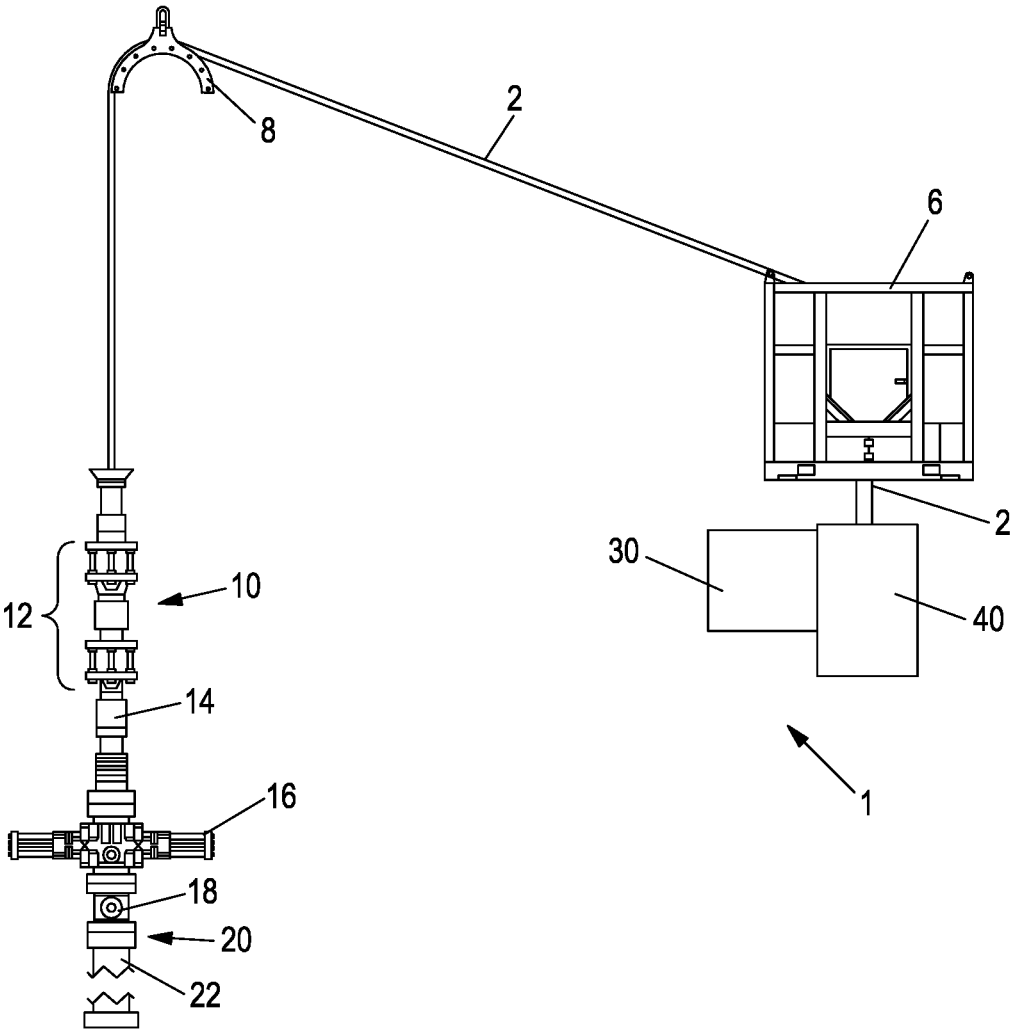
FIG. 1 is a side elevation view of a portion of an apparatus for providing communication with a downhole device positioned within a wellbore.

The foregoing summary, as well as the following detailed description of certain embodiments will be better understood when read in conjunction with the accompanying drawings. As will be appreciated, like reference characters are used to refer to like elements throughout the description and drawings. As used herein, an element or feature recited in the singular and preceded by the word "a" or "an" should be understood as not necessarily excluding a plural of the elements or features. Further, references to "one example" or "one embodiment" are not intended to be interpreted as excluding the existence of additional examples or embodiments that also incorporate the recited elements or features of that one example or one embodiment. Moreover, unless explicitly stated to the contrary, examples or embodiments "comprising", "having" or "including" an element or feature or a plurality of elements or features having a particular property might further include additional elements or features not having that particular property. Also, it will be appreciated that the terms "comprises", "has" and "includes" mean "including but not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of describing the relationship of an element or feature to another element or feature as depicted in the figures. The spatially relative terms can however, encompass different orientations in use or operation in addition to the orientation depicted in the figures.

Reference herein to "example" means that one or more feature, structure, element, component, characteristic and/or operational step described in connection with the example is included in at least one embodiment and or implementation of the subject matter according to the present disclosure. Thus, the phrases "an example," "another example," and similar language throughout the present disclosure may, but do not necessarily, refer to the same example. Further, the subject matter characterizing any one example may, but does not necessarily, include the subject matter characterizing any other example.

Reference herein to "configured" denotes an actual state of configuration that fundamentally ties the element or feature to the physical characteristics of the element or feature preceding the phrase "configured to".

Unless otherwise indicated, the terms "first," "second," etc. are used herein merely as labels, and are not intended to impose ordinal, positional, or hierarchical requirements on the items to which these terms refer. Moreover, reference to a "second" item does not require or preclude the existence of lower-numbered item (e.g., a "first" item) and/or a higher-numbered item (e.g., a "third" item).

As used herein, the terms "approximately" and "about" represent an amount close to the stated amount that still performs the desired function or achieves the desired result. For example, the terms "approximately" and "about" may refer to an amount that is within less than 10% of, within less than 5% of, within less than 1% of, within less than 0.1% of, or within less than 0.01% of the stated amount.

Some of the following examples have been described specifically in relation to well infrastructure relating to oil and gas production, or the like, but of course the systems and methods may be used with other well structures. Similarly, while in the following example an offshore well structure is described, nevertheless the same systems and methods may be used onshore, as will be appreciated.

Aspects of the present disclosure relate to an expansion apparatus which may be used in a wellbore. It should be understood that the drawings presented are not to scale, and may not reflect actual dimensions, ratios, angles, numbers of features or the like.

Figure 2:
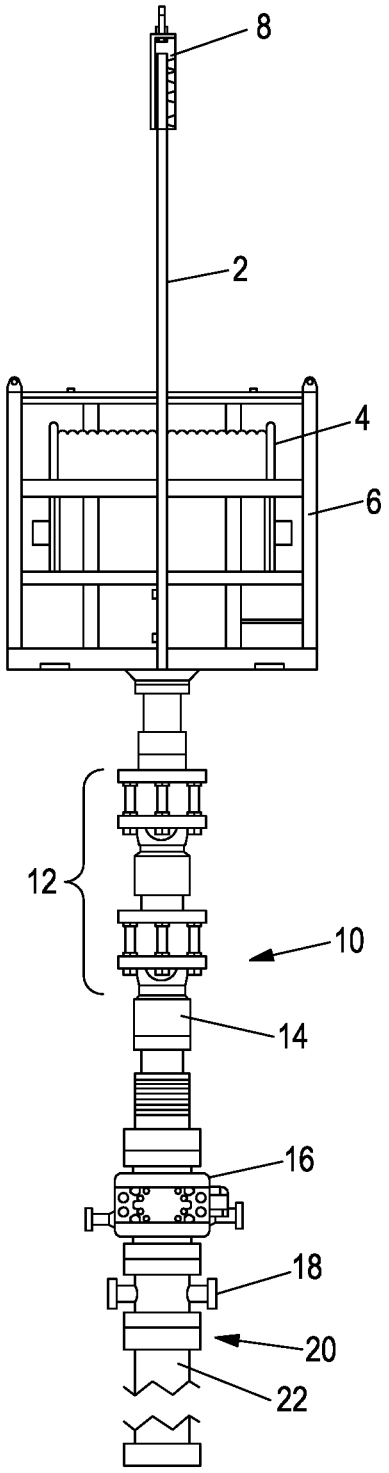
FIG. 2 is a front side elevation view of a portion of the apparatus of FIG. 1.
Figure 3:
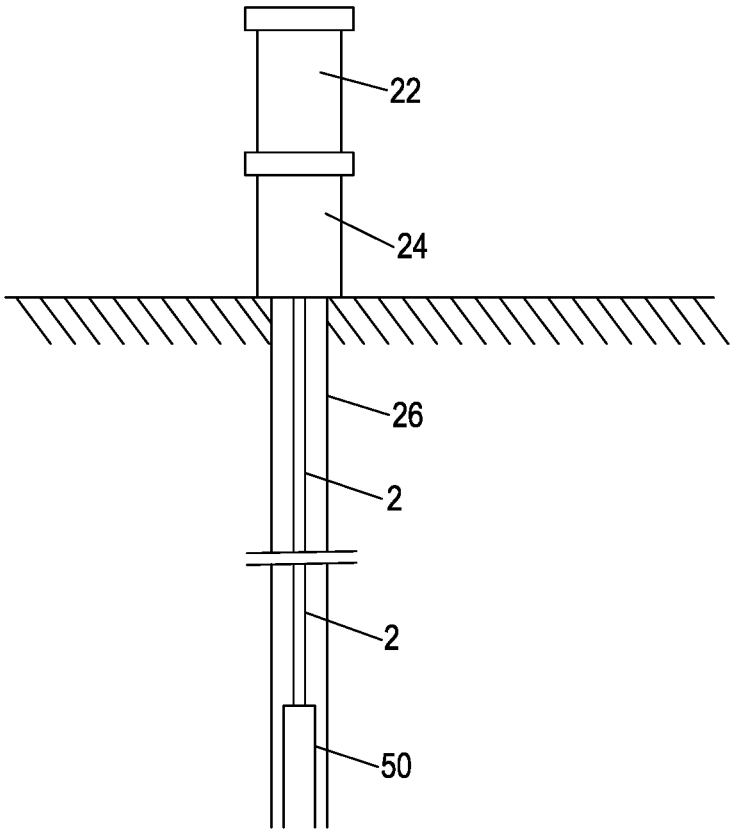
FIG. 3 is a front side elevation view of a portion of the apparatus of FIG. 1.

Turning now to FIGS. 1 to 3, a portion of an apparatus 1 for providing communication with a downhole device positioned within a wellbore is shown. The wellbore may be part of an offshore or onshore well. The well may be a production, abandoned or the like. In FIGS. 1 and 2, the well is a subsea well.

The apparatus 1 comprises a flexible hose 2, which is configured to be run into the wellbore during a well intervention process and to provide a fluid communication path from surface into the wellbore. The flexible hose 2 is provided on a drum 4 supported in a drum housing 6. The drum housing 6 sits on the ground or a deck. The flexible house 2 may be initially, i.e. prior to deployment, wound on the drum 4. The drum 4 includes a pulling mechanism, which can also provide a back tension function. The drum 4 may comprise a motor. The flexible hose 2 may be unwound from the drum 4 during deployment in a wellbore as will be described.

The flexible hose 2 is associated at one end to a surface communication unit 40, and at the other end to a downhole device 50. The flexible hose 2 is electrically connected to the surface communication unit 40 and the downhole device 50 such that a signal may be transferred between the surface communication unit 40 and the flexible hose 2, and a signal may be transferred between the flexible hose 2 and the downhole device 50.

The surface communication unit 40 comprises a processor and a memory. The processor may process data stored in the memory. The processor processes data received from the downhole device 50 and/or controls operation of the downhole device 50. The memory stores commands for operation of the memory and/or stores data received form the downhole device 50.

A fluid source 30 provides fluid to the flexible hose 2, e.g. for hydraulic operation of the downhole device 50. The fluid source 30 provides fluid for supplying hydraulic pressure to operate or control the downhole device 50. The fluid source 30 may be associated with or form part of the surface communication unit 40.

The flexible hose 2 extends from the drum 4 to a guide 8 which guides the flexible hose 2 to the wellbore. The guide 8 deviates the flexible hose 2 from an upwardly inclined direction to a vertical downward direction, towards a wellbore. While a guide 8 has been shown in FIGS. 1 and 2, the flexible hose 2 may be unwound directly from the drum 4 into the wellbore.

The flexible hose 2 extends downwardly from the guide 8 into an intervention stack 10, which comprises a dual stuffing box 12 and a lubricator 14. The dual stuffing box 12 comprises a plurality of stuffing seals, which engage in a sealing manner around the flexible hose 2, to allow the hose 2 to be lowered or raised whilst providing an environment below the dual stuffing box 12 which is sealed from the outside.

A blow-out preventer (BOP) 16 is provided below the intervention stack 10, and a shear seal 18 is provided below the BOP 16. As the well is a subsea well, in this embodiment, a flanged connection 20 to a riser 22 is provided below the shear seal 18. The riser 22 extends substantially vertically downwardly from the surface through the sea to a wellhead 24.

The flexible hose 2 enters the wellbore 26 through the wellhead 24 as shown in FIG. 3. The wellbore 26 may include one or more of casing, piping and tubing. The flexible hose 2 is run into the wellbore 26 and connected to the downhole device 50.

The downhole device 50 may comprise at least one of a measurement device (e.g. gauge, well logging tool), a flow control device (e.g. valve), a perforating device (e.g. perforating gun) and a setting device (e.g. plug, packer). The downhole device 50 is positioned in the wellbore 26. The downhole device 50 is positioned downhole of the surface communication unit 40.

Figure 4A:
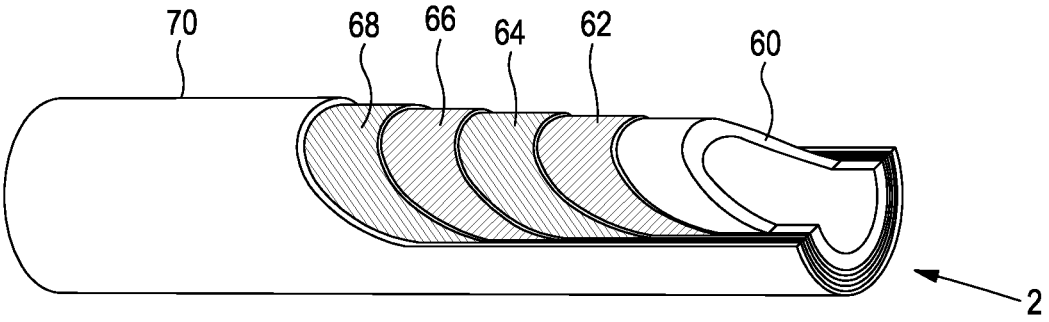
FIG. 4A is a perspective partial sectional view of a flexible hose.

An exemplary flexible hose 2 is shown in more detail in FIG. 4A. The flexible hose 2 comprises a fluid line. The fluid line provides a fluid communication path from the fluid source 30 to the downhole device 50. In this example, the fluid line takes the form of a tube 60. The tube 60 is isolated from wellbore pressure within the wellbore 26. As previously stated, the fluid communicated via the tube 60 may be used to operate the downhole device 50. Surrounding or encircling the tube 60 is a communication medium. The communication medium forms part of the outer wall of the flexible hose 2. The tube 60 has a working pressure of up to 86184 kPa (approximately 12,500 psi).

The communication medium is coupled to the surface communication unit 40 and the downhole device 50. The communication medium is configured for transference of a signal along at least part of a length of the flexible hose 2. Accordingly, the signal may be transmitted between the surface communication unit 40 and the downhole device 50. The signals may be the same signal. In this example, the signal transferred between the surface communication unit 40 and the downhole device 50 is an electromagnetic signal. The signal may be a communication signal for controlling operation of the downhole device 50 via the surface communication unit 40, a data signal, which may include data collected at the downhole device 50 for transference to the surface communication unit 40, and/or a power signal from the surface communication unit 40 to the downhole device 50 for operating the downhole device 50.

In this example, the communication medium comprises one or more of a first metallic element 62, a second metallic element 64, a third metallic element 66 and a fourth metallic element 68. In this example, the metallic elements 62, 64, 66, 68 are braids, although the metallic elements 62, 64, 66, 68 may alternatively be a mesh.

While not shown in FIG. 4A, the metallic elements 62, 64, 66, 68 are electrically isolated from each other. In an exemplary arrangement, one or more nylon layers are positioned between adjacent metallic elements 62, 64, 66, 68. The metallic elements 62, 64, 66, 68 extend along the length of the flexible hose 2. At least one metallic element 62, 64, 66, 68 is electrically connected to the surface communication unit 40 and the downhole device 50. At least one other metallic element 62, 64, 66, 68 is grounded. In this example, at least two metallic elements 62, 64, 66, 68 are used for signal transference between the surface communication unit 40 and the downhole device 50.

While an electromagnetic signal has been described, signal transference may occur via an acoustic signal. In this example, at least one metallic elements 62, 64, 66, 68 may form at least part of the communication medium and be used for signal transference between the surface communication unit 40 and the downhole device 50. The surface communication unit 40 and downhole device 50 each additionally comprise an electroacoustic or acoustic transducer to convert electrical signals to acoustic signals, and to convert acoustic signals to electrical signals.

In this example, the flexible hose 2 further comprises an outer sheath 70 that protects the elements within the sheath 70. The sheath 70 encircles the metallic elements 62, 64, 66, 68 and the tube 60. In this example, the sheath 70 comprises thermoplastic.

Figure 4B:
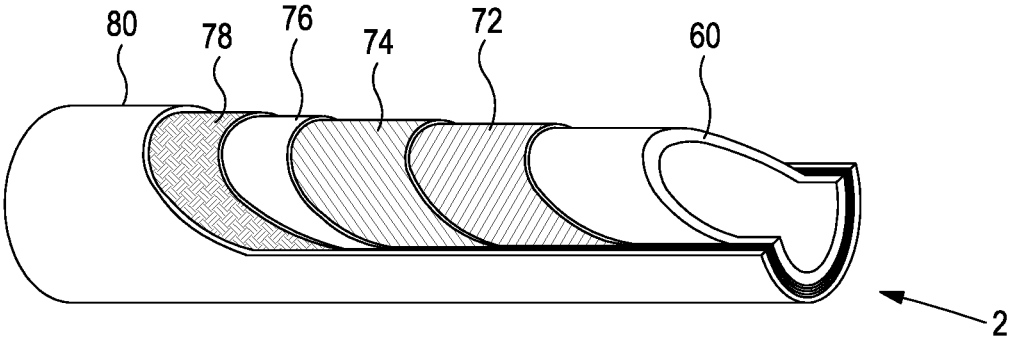
FIG. 4B is a perspective partial sectional view of an alternative form of a flexible hose.

An alternative exemplary form of the flexible hose 2 is shown in FIG. 4B. In this example, the flexible hose 2 comprises a fluid line. The fluid line provides a fluid communication path from the fluid source 30 to the downhole device 50. In this example, the fluid line takes the form of a tube 60. The tube 60 is isolated from wellbore pressure within the wellbore 26. As previously stated, the fluid communicated via the tube 60 may be used to operate the downhole device 50. Surrounding or encircling the tube 60 is a communication medium. The communication medium forms part of the outer wall of the flexible hose 2. The tube 60 has a working pressure of up to 86184 kPa (approximately 12,500 psi).

The communication medium is coupled to the surface communication unit 40 and the downhole device 50. The communication medium is configured for transference of a signal between the surface communication unit 40 and the communication medium, and further for transference of a signal between the downhole device 50 and the communication medium. The signals may be the same signal. In this example, the signal transferred between the surface communication unit 40 and the downhole device 50 is an electromagnetic signal. The signal may be a communication signal for controlling operation of the downhole device 50 via the surface communication unit 40, a data signal which includes data collected at the downhole device 50 for transference to the surface communication unit 40, or a power signal from the surface communication unit 40 to the downhole device 50 for operating the downhole device 50.

In this example, the communication medium comprises a first metallic element 72 and a second metallic element 74. In this example, the metallic elements 72, 74 are braids, although the metallic elements 72, 74 may alternatively be a mesh.

The metallic elements 72, 74 extend along the length of the flexible hose 2. At least one metallic element 72, 74 is electrically connected to the surface communication unit 40 and the downhole device 50. The other metallic element 72, 74 is grounded. The metallic elements 72, 74 may be used for signal transference between the surface communication unit 40 and the downhole device 50. In this example, the metallic elements 72, 74 are electrically connected to each other.

While an electromagnetic signal has been described, signal transference may occur via an acoustic signal. In this example, at least one metallic elements 72, 74 is used for signal transference between the surface communication unit 40 and the downhole device 50.

In this example, the flexible hose 2 further comprises an inner sheath 76 that protects the elements within the inner sheath 76. The inner sheath 76 encircles the metallic elements 72, 74 and the tube 60. In this example, the inner sheath 76 comprises thermoplastic. In another example, the inner sheath 76 comprise one or more nylon layers.

The flexible hose 2 further comprises a flexible layer 78. The flexible layer 78 comprises a tensile membrane. The tensile membrane is configured to stretch when connected to the downhole device 50 deployed downhole of the surface communication unit 40. The tensile membrane thus takes the weight of the downhole device 50 such that the metallic elements 72, 74 do not have weight put on them.

The flexible layer 78 further comprises a third metallic element such that signal transference may occur through the third metallic element. In particular, signal transference may occur through one of the first and second metallic elements 72 and 74, respectively, and through the third metallic element of the flexible layer 78. The other of the first and second metallic elements 72 and 74, respectively, is grounded. The inner sheath 76 electrically isolates the metallic elements 72, 74, and the third metallic element of the flexible layer 78.

The flexible hose 2 further comprises an outer sheath 80 that protects the elements within the outer sheath 80. The outer sheath 80 encircles the metallic elements 72, 74, tube 60, inner sheath 74 and flexible layer 78. In this example, the outer sheath 80 comprises thermoplastic.

While the flexible hose 2 has been described as including flexible layer 78, and inner and outer sheaths 74 and 80 in reference to the exemplary embodiment shown in FIG. 4B, these elements could be present in the exemplary embodiment shown in FIG. 4A and described above.

Figure 5:
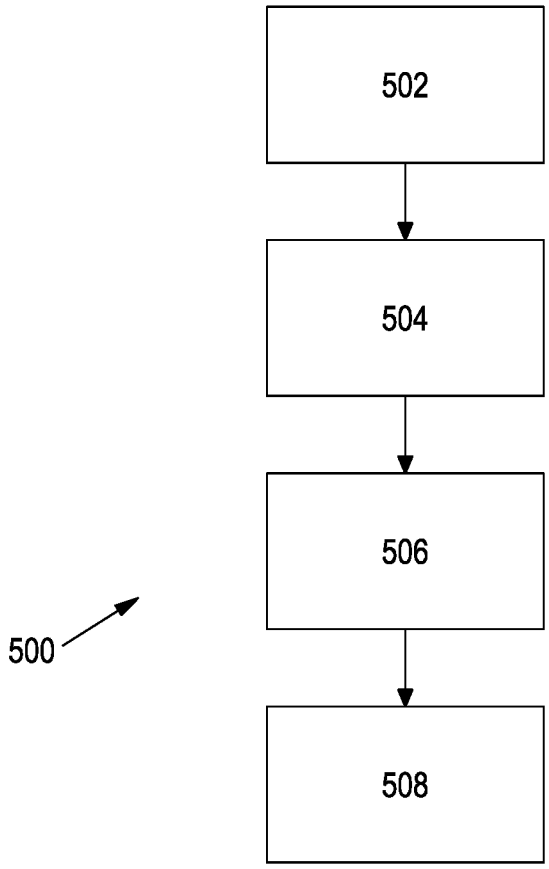
FIG. 5 is a flowchart of a method for communicating data.

Turning now to FIG. 5, a flowchart of a method 500 for communicating data to and/or from the downhole device 50 positioned within the wellbore 26 using the flexible hose 2 is shown. The method 500 comprises coupling 502 the downhole device 50 to the communication medium of the flexible hose 2. The method 500 further comprises coupling 504 the surface communication unit 40 to the communication medium of the flexible hose 2. As explained above, the couplings may comprise an electrical connection, which may be wired or wireless. In specific arrangements, the downhole device 50 and the surface communication unit 40 may be physically connected to the communication medium such that electrical signals may be transmitted into and received from the communication medium.

The method 500 further comprises running 506 the flexible hose 2 and the downhole device 50 into the wellbore 26 during a well intervention process.

The downhole device 50 is for positioning in the wellbore 26. The surface communication unit 40 is for communicating data to the downhole device 50 and/or receiving data from the downhole device 50. The flexible hose 2 provides a fluid communication path from surface into the wellbore 26. As previously stated, the communication medium may comprise one or more metallic elements 62, 64, 66, 68, 72, 74.

The method 500 may further comprise communicating 508 a signal, electromagnetic or acoustic, between the downhole device 50 and the surface communication unit 40. Communicating 508 the signal comprises communicating the signal along at least one the metallic elements 62, 64, 66, 68, 72, 74 and the metallic element in flexible layer 78.

Communicating 508 the signal may comprise communicating an actuation signal via the communication medium from the surface communication unit 40 to the downhole device 50 to actuate the downhole device 50.

In operation, the surface communication unit 40 may actuate the downhole device 50 via a signal transmitted along the communication medium. Thus, the signal being transferred may be a power signal. The downhole device 50 may be controlled to detect parameters such as pressure, temperature, electrical resistivity and conductivity, strain and/or force. The detected parameters may be transmitted back to the surface communication unit 40 via the communication medium. Thus, the signal being transferred may be a data communication signal. The signals may be transferred via one or more of an electromagnetic signal and an acoustic signal.

The described apparatus may be used in a variety of applications. These include running a plug and verifying plug integrity. The plug may form the downhole device 50 and be actuated downhole via a signal transferred on the communication medium of the flexible hose 2. Once the plug is set, a pressure sensor associated with the plug may be controlled by signal transmission from the surface communication unit 40 to the sensor. The pressure sensor may collect a pressure measurement and transfer this measurement via the communication medium of the flexible hose 2 back to the surface communication unit 40. The surface communication unit 40 can then verify the plug integrity in real time without the need for another downhole device or a separate and distinct communication line to be run. Cement can then be pumped on top of the plug via the tube 60 of the flexible hose 2. The pressure can then be re-verified by communicating a pressure measurement collected by the pressure sensor and communicated to the surface communication unit 40 via the communication medium. The wellbore may be plug, verified, cemented and re-verified in a single run.

A further application includes running tubing-conveyed perforation (TCP) guns and clean-up on a single run of the flexible hose 2. The TCP guns form at least part of the downhole device 5 and are run into the wellbore 26. The guns are activated via signal communication along the communication medium. Real-time confirmation of gun activation can be transmitted to the surface communication unit 40 along the communication medium. The well may then be cleaned-up/conditioned and high density fluid may be spotted. The TCP guns may then be pulled out of the wellbore 26.

The downhole device 50 may include a caliper and clean up devices such that the calliper can be run and data collected transferred to surface via the communication medium, then clean up fluids (e.g. brine, acid) may be pumped downhole via the tube 60, and the calliper may be re-run to verify clean-up. This single run clean speeds up clean-up operations that generally require multiple downhole runs.

The applicant hereby discloses in isolation each individual feature described herein and any combination of two or more features, to the extent that such features or combinations are capable of being carried out based on the present specification as a whole in the light of the common general knowledge of a person skilled in the art, irrespective of whether such features or combination of features solve any problems disclosed herein, and without limitation to the scope of the claims. The applicant indicates that aspects of the disclosure may consist of any such individual feature or combination of features. In view of the foregoing description, it will be evident to a person skilled in the art that various modifications may be made within the scope of the disclosure.

The invention claimed is:

1. An apparatus for providing communication with a downhole device positioned within a wellbore, the apparatus comprising:

a flexible hose configured to be run into the wellbore during a well intervention process and to provide a fluid communication path from surface into the wellbore, wherein the flexible hose comprises at least one communication medium forming at least part of an outer wall thereof;

a downhole device for positioning within the wellbore and coupled to the at least one communication medium for transference of a signal between the downhole device and the at least one communication medium; and a surface communication unit for communicating data to the downhole device and/or receiving data from the downhole device, wherein the surface communication unit is coupled to the at least one communication medium for transference of a signal between the surface communication unit and the at least one communication medium;

wherein the at least one communication medium of the flexible hose comprises a first metallic element extending at least partially along a length of the flexible hose and a second metallic element extending at least partially along the length of the flexible hose, the first metallic element co-axial with the second metallic element, the first metallic element surrounding a central bore of the flexible hose, the second metallic element surrounding the central bore of the flexible hose, and the second metallic element encircling the first metallic element;

wherein the flexible hose further comprises a flexible layer comprising a tensile membrane and a third flexible metallic element; and wherein the flexible hose further comprises an inner sheath adapted to protect elements within the inner sheath, the inner sheath encircling the first metallic element and the second metallic element, the inner sheath electrically isolating the third flexible metallic element from the first metallic element and the second metallic element, and the third metallic element encircling the inner sheath.

2. The apparatus of claim 1, wherein the flexible hose comprises one or more fluid lines configured to provide the fluid communication path.

3. The apparatus of claim 2, wherein the at least one communication medium encircles the one or more fluid lines.

4. The apparatus of claim 1, wherein the second metallic element is electrically isolated from the first metallic element.

5. The apparatus of claim 1, wherein the first metallic element comprises a first braid and/or the second metallic element comprises a second braid.

6. The apparatus of claim 1, wherein the third flexible metallic element extends at least partially along the length of the flexible hose.

7. The apparatus of claim 6, wherein the at least one communication medium further comprises a fourth metallic element extending at least partially along the length of the flexible hose; and wherein the fourth metallic element is electrically isolated from at least one of the first metallic element, the second metallic element, and the third flexible metallic element.

8. The apparatus of claim 7, wherein at least two of the first metallic element, the second metallic element, the third flexible metallic element and the fourth metallic element are bonded to each other.

9. The apparatus of claim 7, wherein at least one of the first metallic element, the second metallic element, the third flexible metallic element and the fourth metallic element comprise steel or high tensile steel.

10. The apparatus of claim 1, wherein the outer wall of the flexible hose comprises a flexible material.

11. The apparatus of claim 1, wherein the flexible hose is configured for storage at surface on a drum, and further configured to be unwound from the drum during deployment in the wellbore.

12. The apparatus of claim 11, wherein the flexible hose is a coil hose.

13. The apparatus of claim 1, wherein the signal transferred between the downhole device and the at least one communication medium is one of an electromagnetic signal or an acoustic signal; and wherein the signal transferred between the surface communication unit and the at least one communication medium is one of an electromagnetic signal or an acoustic signal.

14. The apparatus of claim 1, wherein the downhole device comprises at least one of a measurement device, a flow control device, a perforating device and a setting device.

15. The apparatus of claim 1, further comprising a communication relay for positioning within the wellbore and coupled to the at least one communication medium for transference of a signal between the communication relay and the at least one communication medium;

wherein the downhole device is configured to be positioned downhole of the communication relay, and wherein the downhole device is coupled to the at least one communication medium for transference of a signal between the downhole device and the communication relay.

16. The apparatus of claim 15, the downhole device for measuring a property of a reservoir and/or wellbore fluid.

17. The apparatus of claim 15, the downhole device for positioning within a section of the wellbore, wherein the downhole device is configured to isolate the section of the wellbore.

18. The apparatus of claim 17, wherein the surface communication unit is configured to control actuation of the downhole device to pressure test the section via transmission of a control command on the at least one communication medium.

19. The apparatus of claim 18, wherein the downhole tool is a perforating device, and wherein the surface communication unit is configured to control actuation of the perforating device via transmission of a control command on the at least one communication medium.

20. The apparatus of claim 1, wherein the signal is at least one of a data communication signal or a power signal.

21. A method for communicating data to and/or from a downhole device positioned within a wellbore using a flexible hose, the flexible hose comprising at least one communication medium forming at least part of an outer wall thereof, wherein the at least one communication medium of the flexible hose comprises a first metallic element extending at least partially along a length of the flexible hose and a second metallic element extending at least partially along the length of the flexible hose, the first metallic element co-axial with the second metallic element, the second metallic element encircling the first metallic element, the first metallic element surrounding a central bore of the flexible hose, the second metallic element surrounding the central bore of the flexible hose, wherein the flexible hose further comprises a flexible layer comprising a tensile membrane and a third flexible metallic element, and wherein the flexible hose further comprises an inner sheath adapted to protect elements within the inner sheath, the inner sheath encircling the first metallic element and the second metallic element, the inner sheath electrically isolating the third flexible metallic element from the first metallic element and the second metallic element, the third flexible metallic element encircling the inner sheath, the method comprises:

coupling a downhole device to the at least one communication medium of the flexible hose, the downhole device for positioning within the wellbore;

coupling a surface communication unit to the at least one communication medium of the flexible hose, the surface communication unit for communicating data to the downhole device and/or receiving data from the downhole device; and running the flexible hose in the wellbore during a well intervention process, the flexible hose for providing a fluid communication path from surface into the wellbore.

22. The method of claim 21, further comprising communicating a signal between the downhole device and the at least one communication medium and/or between the at least one communication medium and the surface communication unit.

23. The method of claim 22, wherein communicating the signal comprises communicating the signal along at least one of the first metallic element and the second metallic element, the second metallic element electrically isolated from the first metallic element.

24. The method of claim 22, further comprising communicating actuation of the downhole device via the data communication signal between the downhole device and the at least one communication medium.

25. The method of claim 22, wherein the data communication signal between the downhole device and the at least one communication medium is one of an electromagnetic signal and an acoustic signal; and wherein the data communication signal between the surface communication unit and the at least one communication medium is one of an electromagnetic signal and an acoustic signal.

26. The method of claim 22, wherein the signal is at least one of a data communication signal or a power signal.

27. The method of claim 21, further comprising communicating a signal between the downhole device and a communication relay for positioning within the wellbore and coupled to the at least one communication medium for transference of a signal between the communication relay and the at least one communication medium.

28. The method of claim 21, further comprising detecting parameters at the downhole device downhole of the surface communication unit.

* * * * *